US006679019B2

(12) United States Patent
Rochman

(10) Patent No.: US 6,679,019 B2
(45) Date of Patent: Jan. 20, 2004

(54) METHOD AND APPARATUS FOR REINFORCING A DOOR

(75) Inventor: Oded E. Rochman, Thornhill (CA)

(73) Assignee: Rochman Universal Doors, Inc. (CA)

( * ) Notice: Subject to any disclaimer, the term of this patent is extended or adjusted under 35 U.S.C. 154(b) by 101 days.

(21) Appl. No.: 10/042,170

(22) Filed: Jan. 11, 2002

(65) Prior Publication Data

US 2002/0092258 A1 Jul. 18, 2002

Related U.S. Application Data

(60) Provisional application No. 60/261,186, filed on Jan. 16, 2001.

(51) Int. Cl.[7] ..... E06B 3/70; E04C 2/54

(52) U.S. Cl. ..... 52/455; 52/784.1; 52/784.15; 70/416; 70/417; 70/450; 70/466; 292/DIG. 2

(58) Field of Search ..... 52/456, 455, 784.1, 52/784.15, 630; 70/416, 417, 450, 451, 466; 292/337, DIG. 2

(56) References Cited

U.S. PATENT DOCUMENTS 4,080,813 A * 3/1978 McKann ..... 70/450
4,832,388 A 5/1989 Lozano ..... 292/340
4,854,622 A 8/1989 Lozano ..... 292/340
4,989,428 A * 2/1991 Prevot ..... 70/448
5,586,796 A * 12/1996 Fraser ..... 292/346
5,634,508 A * 6/1997 Herbst ..... 160/371
5,735,147 A * 4/1998 Cattanach et al. ..... 70/164
5,787,741 A * 8/1998 Shen ..... 70/107
5,816,017 A * 10/1998 Hunt et al. ..... 52/784.11
5,950,465 A * 9/1999 Schultz et al. ..... 70/416
6,094,869 A * 8/2000 Magoon et al. ..... 49/460

* cited by examiner

*Primary Examiner*—Jeanette E. Chapman
(74) *Attorney, Agent, or Firm*—Liniak, Berenato & White, LLC

(57) ABSTRACT

A door assembly is disclosed that includes a latch-side stile with bores for accommodating one or more bolts that extend through the stile and into an adjacent doorjamb to secure door with respect to the doorjamb. A reinforcing plate is mounted on the inner edge of the latch-side stile with flared flanges extending into the stile bores to hold the plate in place and to make it more difficult to force the door open by kicking the door in the area of its latch and lock. A method of assembling a door including such a reinforcing plate is also disclosed.

22 Claims, 7 Drawing Sheets

METHOD AND APPARATUS FOR REINFORCING A DOOR

This application claims the benefit of provisional application 60/261,186 filed Jan. 16, 2001.

FIELD OF THE INVENTION

The present invention is directed toward a method and apparatus for strengthening the frame of a door, and, more specifically, toward a device mounted inside a hollow-core door to reinforce a portion of the door stile in the vicinity of openings that accommodate locking or latching hardware.

BACKGROUND OF THE INVENTION

Doors have traditionally been formed from solid pieces of wood. As wood has become increasingly expensive, alternative types of doors have become more common. One such alternative door is formed by two parallel vertical stiles connected by top and bottom rails to form a rectangular frame and two thin panels or door skins attached to the frame to form a door with a hollow-core. Such doors are lighter than solid wood doors, have a lower material cost, and, if the space between the door skins is filled with a suitable insulating material, may provide better thermal insulation.

A first pair of aligned openings is provided in the door skins to receive a door handle or latching assembly and, optionally, a second pair of openings may be provided to accommodate a deadbolt or other lock. Latch bores extend through the stile next to these openings to allow a live bolt and/or a deadbolt to pass through the stile and into a corresponding opening in a doorjamb adjacent the latch side of the door. Optionally, a lock block with bores aligned with the door skin openings may be attached to the stile inside the door next to the latch bore to provide a secure mounting location for the door handle and lock hardware.

Drilling latch openings though a stile weakens the stile significantly, and it is known that doors may be forced by delivering a sharp kick or otherwise applying a force in the area of the latch bore to split the wooden stile. This weakening occurs even when a solid piece of a sturdy wood is used; with lighter woods, such as sometimes used in hollow-core doors to reduce weight, the problem is even more significant. When an ordinary door is kicked near the lock assembly, the metal strike plate in the doorjamb holds the distal end of the door bolt relatively securely while the door is forced slightly inwardly. As the door moves, the latch or bolt pivots within the bore, and if a great enough force is applied, snaps the stile near the latch bore. Once the end of the bolt inside the door begins to pivot, it can act as a lever to pry the strike plate out of the doorjamb when further force is applied to the door. If a first kick does not completely open the door, the latch will be damaged enough to allow some play and let the door move back and forth. Weakened in this manner, it is highly likely that a subsequent kick will completely break the bolt from the door and allow the door to be opened.

This problem has been recognized, and various attempts have been made to address it. For example, it is known from U.S. Pat. No. 5,586,796 to provide metal plates on the inside and outside faces of a door to reinforce the area around the lock and latch. While this approach does provide some additional strength, it also adversely affects the appearance of a door, giving it a commercial or industrial look. Alternately, U.S. Pat. No. 4,832,388 shows the use of unusually long screws for securing a strike plate to a doorjamb and for securing a reinforcing plate to the outer edge of the door, the screws being installed at an angle to the door and the doorjamb to make them more difficult to remove by force. However, this method requires that a large mortised region be formed on the outside edge of the door to accommodate the reinforcing plate. Moreover, because the reinforcing plate will be visible when the door is open, the plate should be made from a material with a finished appearance that matches the other door hardware, adding to the cost of the door. Furthermore, the oversized reinforcing plate may not be as aesthetically pleasing as the smaller plates that generally surround the live bolt of a door.

It would therefore be desirable to provide a reinforcement for a door that is economical to produce and install, that can be sold as an integral part of a hollow-core door, and that can be used without affecting the outward appearance of a door.

SUMMARY OF THE INVENTION

These problems and others are addressed by the present invention which includes a reinforcing plate mounted inside a door frame on the inner edge of the stile through which latch bores are drilled. In a preferred embodiment, the plate includes an opening aligned with each bore in the stile so that a live bolt or deadbolt can pass therethrough. When the door is closed and the bolt is extended, the bolt also extends though a strike plate mounted on a doorjamb and into an opening in the doorjamb. In one embodiment, the plate includes a flange surrounding each opening which flange extends into each bore to reinforce the bore and the stile. The flange preferably has at least one portion that is wider than the bore into which it is placed and may have outwardly flared or barbed end edges to help secure the plate to the stile. Alternately, or in addition, the plate may be dimpled or punched at locations spaced from the openings to form protrusions that extend into the stile to help secure the plate.

In a second embodiment, the plate is provided with several groups of screw holes arranged in circular regions lying on either side of each of the plate openings along the longitudinal centerline of the plate. When a latch plate is installed on the outer edge of the latch stile of a door incorporating the subject reinforcing plate, longer-than-usual screws are used to attach the latch plate to the stile, which screws extend thought the stile and pass through one of the screw holes in the plate and into the body of the lock block.

The plate in the door assembly of the preferred embodiment of the present invention provides support for a section of the bolt inside the door, away from the doorjamb. Thus, if a forced entry is attempted, the bolt is less likely to pivot in the door, and an intruder will essentially need to press the bolt, the reinforcing plate and the strike plate in a direction normal to the plane of the door to obtain entry. Because the reinforcing plate is securely mounted to the stile and the strike plate is secured to the doorjamb, a significant effort will be required to force the door open. While enough force will break any door, the present invention makes it appreciably more difficult to break down a door in the above-described manner.

Preferably, the subject plate is press-fitted to the inner edge of the stile while the door is being manufactured and thus does not require separate fasteners or adhesives to hold it in place. Furthermore, because the plate is inside the door, there is no need to provide a mortise to accommodate the plate and keep it flush with another surface. Also, because the plate is hidden after it is installed, it can be formed from an unfinished sheet of material, and the same material can be used on any door without regard for its outward appearance.

It is therefore a principal object of the present invention to provide a method of reinforcing a door that does not affect the outward appearance of the door.

It is another object of the present invention to provide an internally mounted reinforcing plate for a door stile.

It is another object of the present invention to provide a reinforcing plate that can be press-fitted to a frame of a door during manufacture.

It is yet another object of the present invention to provide a reinforcing plate having at least one flanged opening that is received in a latch bore in a door stile for reinforcing the stile.

It is yet a further object of the present invention to provide a method of reinforcing the frame of a door having more than one latch bore for accommodating more than one bolt.

In accordance with these objectives, a door is disclosed that includes a first stile having a front wall, a rear wall, an inner wall, and an outer wall; a second stile parallel to and spaced from the first stile and including an inner wall facing the first stile inner wall; a first door skin connected to the first stile and to the second stile; a second door skin connected to the first stile and to the second stile; a first lock bore extending through the first door skin and the second door skin; and a first latch bore extending from the first lock bore through the first stile inner wall and the first stile outer wall. The door also includes a reinforcing plate connected to the first stile inner wall having a first opening aligned with the first latch bore.

A method of forming a reinforced door is also disclosed, which method comprises the steps of: 1) taking a frame formed from first and second parallel side stiles having facing inner walls, a top rail connected between the first and second stiles and a bottom rail connected between the first and second stiles, 2) forming a latch bore having a diameter through the first stile, 3) taking a reinforcing plate including a flanged opening having a width greater than the first diameter and aligning it with the latch bore and pressing the flange into the latch bore until the plate contacts the stile and then attaching first and second door skins to the frame.

Another embodiment of a door according to the present invention includes a door frame having a latch stile, a hinge stile, and a top rail and a bottom rail connected between the latch stile and the hinge stile, the latch stile having an inner wall facing the hinge stile and a latch bore though the inner wall. A reinforcing shield has an opening with a flange with a first portion of the flange having a width greater than the width of the latch stile latch bore extends into the latch stile latch bore. A reinforcing shield overlies the latch stile inner wall and includes at least one projection extending into the latch stile at a location spaced from the latch stile latch bore. A lock block has a lock bore connected to the latch stile inner wall and has a lock block latch bore aligned with the latch stile latch bore. First and second door skins are connected to the door frame and having openings aligned with the lock bore.

BRIEF DESCRIPTION OF THE DRAWINGS

These and further objects and advantages of the invention will be better understood after a reading of the following detailed description of the invention together with the following drawings.

DETAILED DESCRIPTION OF THE INVENTION

Figure 1:
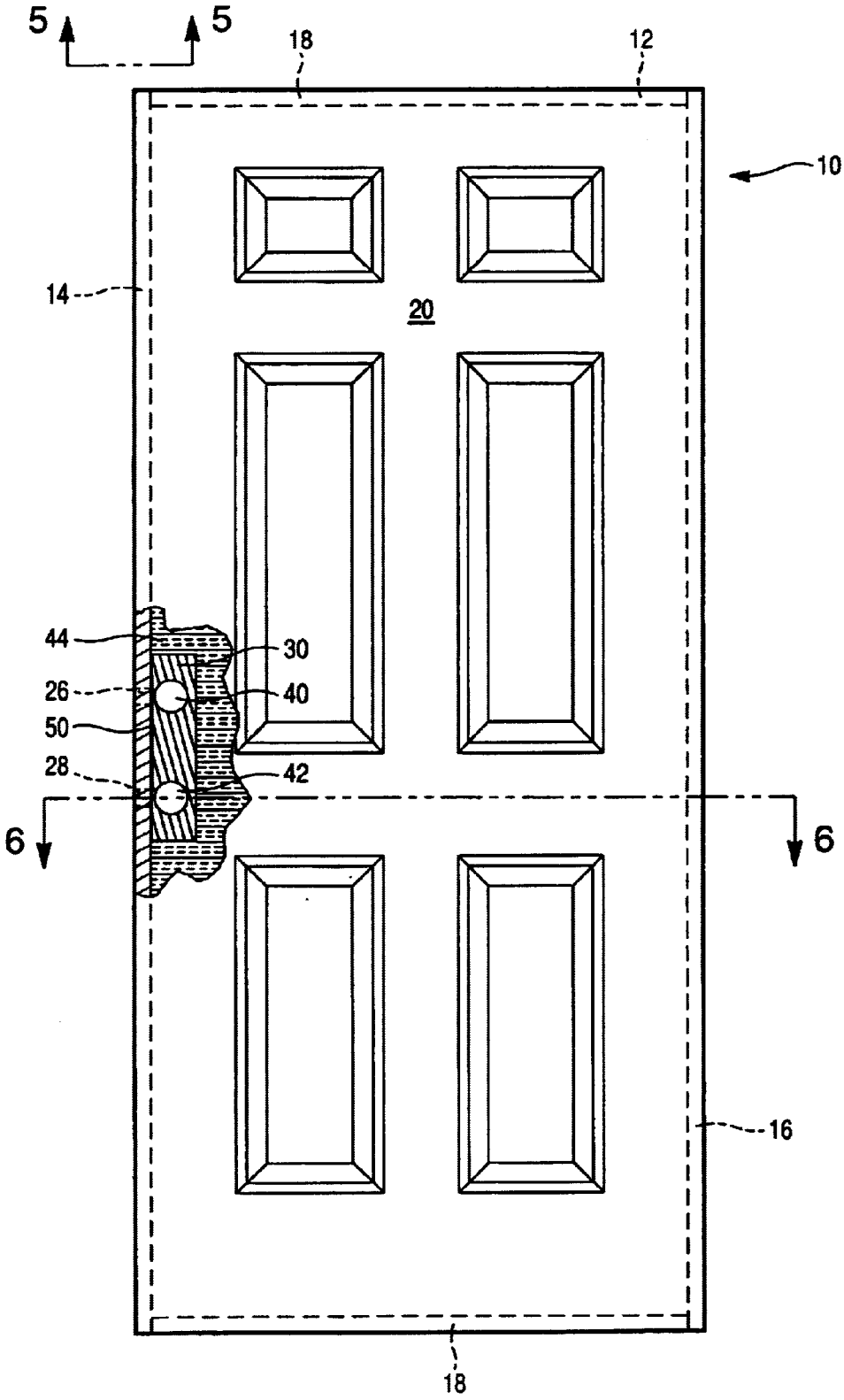
FIG. 1 is a side elevational view, with a portion broken away, of a door assembly including a reinforcing plate according to the present invention.
Figure 5:
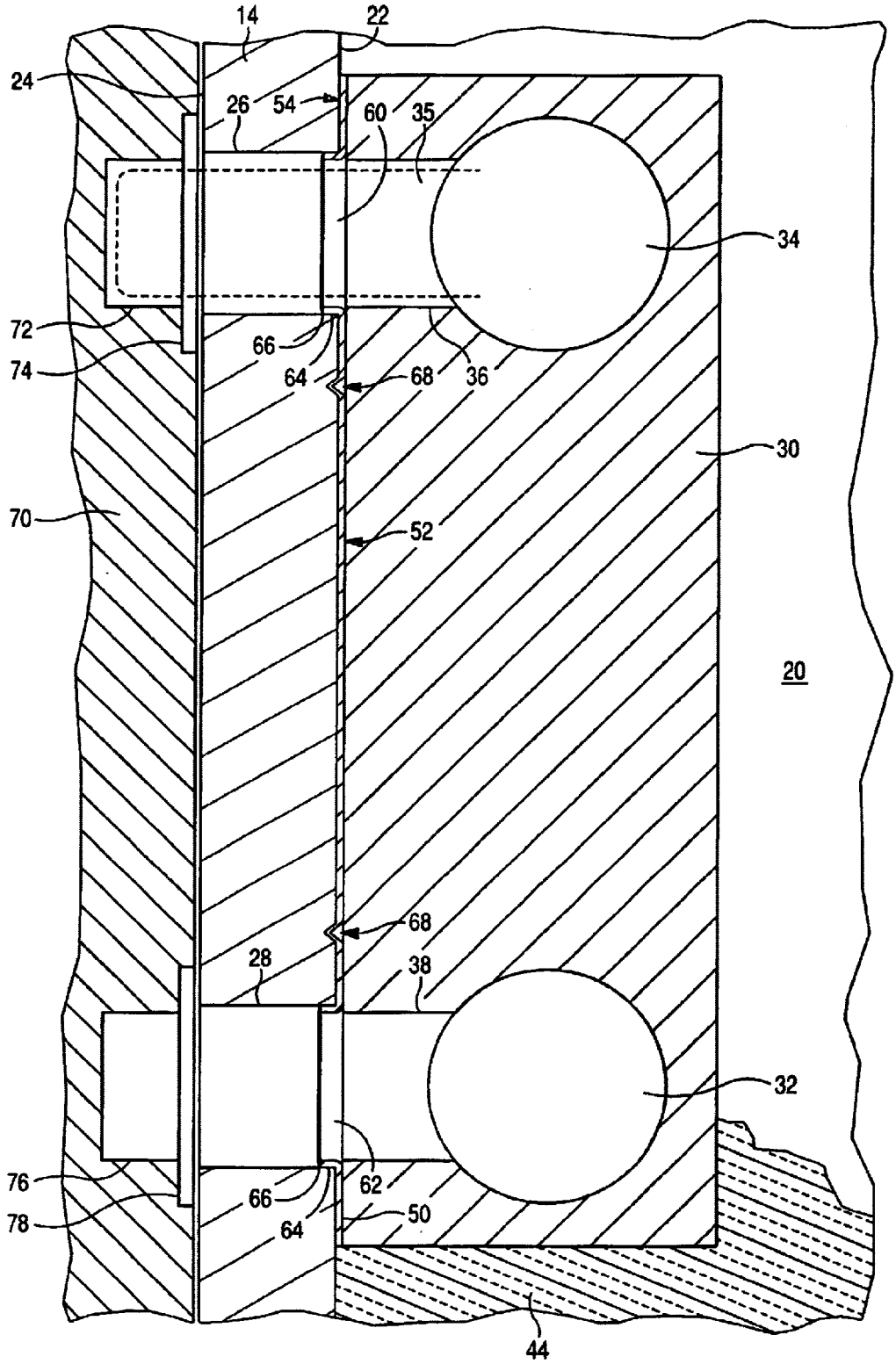
FIG. 5 is a cross sectional view taken along line 5—5 of FIG. 1.
Figure 6:
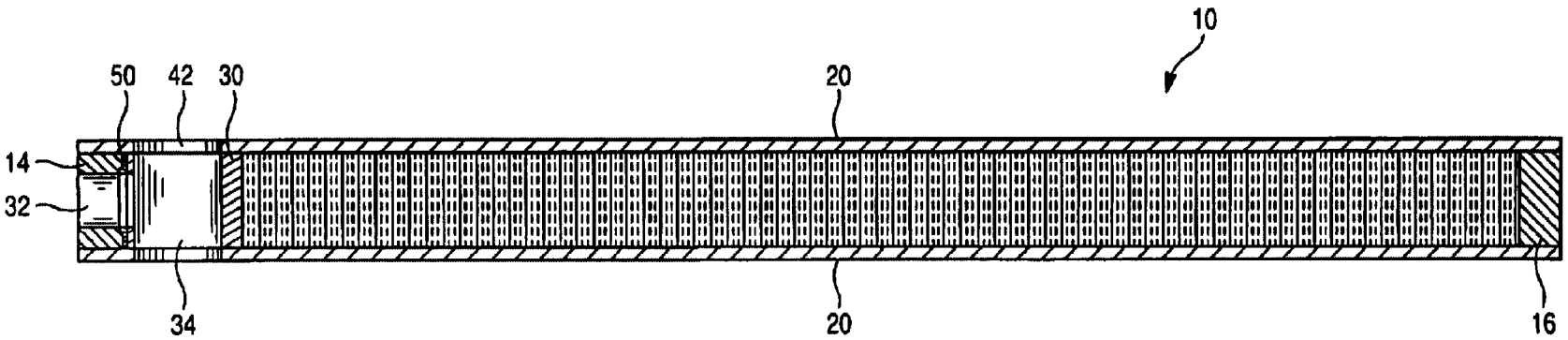
FIG. 6 is a cross sectional view taken along line 6—6 in FIG. 1.

Referring now to the drawings, wherein the showings are for the purpose of illustrating a preferred embodiment of the invention only, and not for the purpose of limiting same, FIGS. 1 and 6 show a door 10 comprising a door frame 12 including a latch stile 14, a hinge stile 16, upper and lower rails 18 connecting the latch stile to the hinge stile and two door skins 20 connected to opposite sides of door frame 12 in a well known manner. ("Upper," "lower" and other directional terms used herein refer to a door positioned in a normal vertical orientation.) As best seen in FIG. 5, latch stile 14 has an inner wall 22, an outer wall 24, an upper latch bore 26 and a lower latch bore 28 extending though the stile between inner wall 22 and outer wall 24. A lock block 30 is attached to latch stile 14 in a conventional manner, such as by staples, screws, bolts, fasteners, glue, etc. (not shown) and includes a lower opening 32 for receiving hardware associated with a door latch (not shown) and an upper opening 34 for receiving an auxiliary lock, such as a deadbolt, the bolt portion 35 of which is shown in phantom lines in FIG. 5. A lock block upper latch bore 36 extends from upper opening 34 though a side wall of the lock block while a lock block lower latch bore 38 extends from lower opening 32 through the lock block side wall. Door skins 20 are provided with an upper pair of aligned openings 40 that align with upper opening 34 in the lock block and a lower pair of aligned openings 42 that are aligned with lower opening 32 in the lock block. The door may also include insulation 44 of any conventional type, such as foam insulation.

Figure 2:
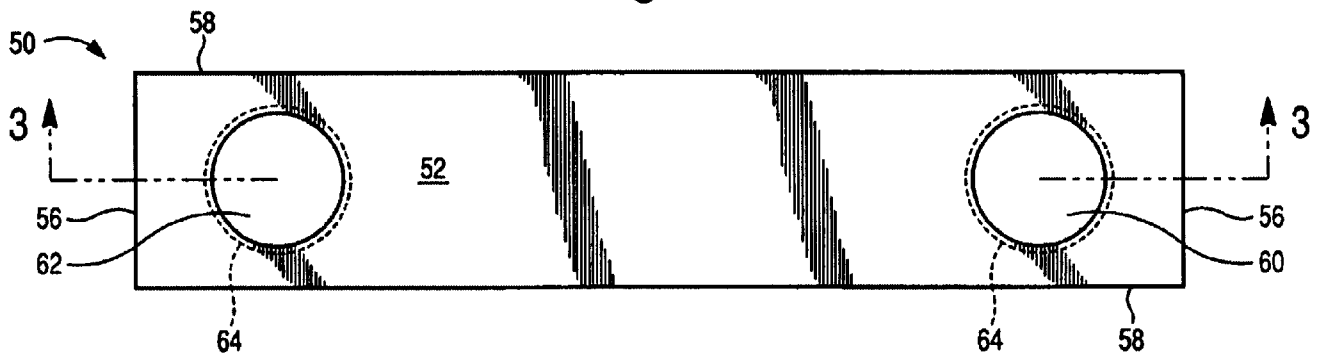
FIG. 2 is a top plan view of the reinforcing plate of FIG. 1.
Figure 3:
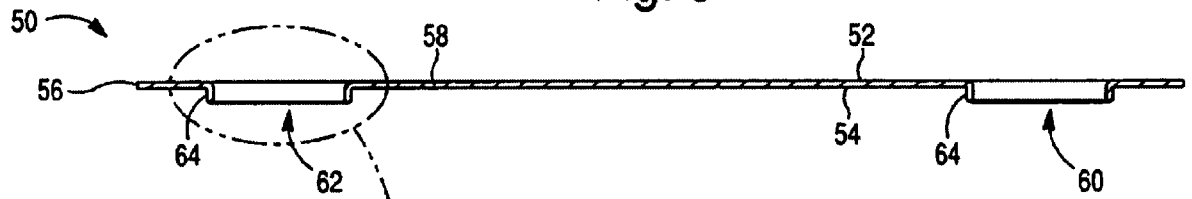
FIG. 3 is a cross sectional view taken along line 3—3 of FIG. 2.
Figure 4:
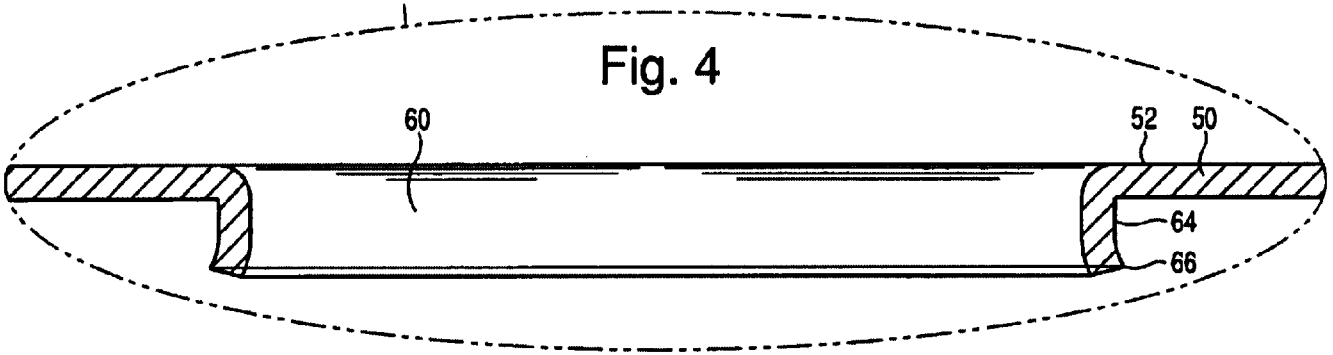
FIG. 4 is an enlarged detail of a portion of FIG. 3.

Door 10 further includes a reinforcing guard or plate 50, shown separately from door 10 in FIGS. 2–4, that is preferably formed from 0.035 inch thick galvanized steel, which plate includes a front face 52, a rear face 54, top and bottom edges 56, side edges 58, an upper hole 60 and a lower hole 62. The distance between the side edges 58 is approximately equal to the width of the stile to which the plate will be attached as shown in FIG. 6. The upper and lower holes are centered between the side edges 58 and located near the top and bottom edges of the plate and are formed in a manner that produces flanges 64 around both openings extending from rear face 54 of the plate. Furthermore, the flanges are provided with outturned end edges 66. These outturned end edges bite into the wood of latch stile 14 to help hold plate 50 in place as will be described hereinafter and, as the sharp edges point away from the centerline of the holes, the risk that a person installing hardware though the plate will come into contact with these sharp edges is reduced. Dimples 68, as best shown in FIG. 5, are formed in plate 50 after it is attached to stile 14 by pressing a diamond-shaped tool into the plate to deform the plate and force portions of the plate into the stile 14. These dimples, together with the force fit of the flanges in the bores in the latch stile, securely hold plate 50 in place without the use of adhesives or additional hardware.

Referring again to FIG. 5, a portion of door 10 is shown positioned adjacent to a doorjamb 70 which doorjamb includes an upper bolt opening 72 surrounded by an upper strike plate 74 and a lower bolt opening 76 surrounded by a lower strike plate 78. When door 10 is closed, upper bore 26 aligns with upper bolt opening 72 and lower bore 28 aligns with lower bolt opening 76. Bolt 35 is shown extending from upper opening 34 through lock block upper latch bore 36, reinforcing plate upper hole 60, upper latch stile bore 26, strike plate 74 and into opening 72 in the doorjamb. A live latch bolt would extend through the lower latch stile bore into the doorjamb in a similar manner.

An attempt to force open door 10 would likely involve the application of a sharp force to the area of the door between openings 40 and 42 in the door skins. Such a force applied to an un-reinforced door would likely cause bolt 35 to twist in upper bore 26 and shatter the wood of latch stile 14 which is relatively thin in the area around the latch bores. Reinforcing plate 50 secures bolt 35 against such twisting, so that bolt 35 can only move normally to door skins 20 under the application of a force normal to the surface of the door. In order to forcibly open a door including a reinforcing plate 50, the bolt would have to press against reinforcing plate 50 and strike plate 74 and move them directly out of the page as seen in FIG. 5. This would require substantially more force than would be required to pivot bolt 35 and split the wood of stile 14 of an un-reinforced door, because the flanges 64 and dimples 68 substantially prevent face 58 of the plate from sliding relative to inner wall 22 of stile 14.

A method of assembling a door that includes a reinforcing plate 50 will now be described with reference to FIG. 7. This method includes the steps of providing a door frame having a latch stile, a hinge stile and top and bottom rails connecting the stiles, forming at least one latch bore through the latch stile having a diameter, providing a reinforcing plate having a flanged opening with an outturned free end larger than the diameter of the latch stile bore, aligning the flange with the latch stile bore and pressing the flange into the latch stile bore until the flat portion of the plate contacts the stile, and then, optionally, pressing a tool against the flat portion of the plate to form dimples extending into the stile, then attaching a lock block over the reinforcing plate and attaching door skins to the door frame.

Figure 7:
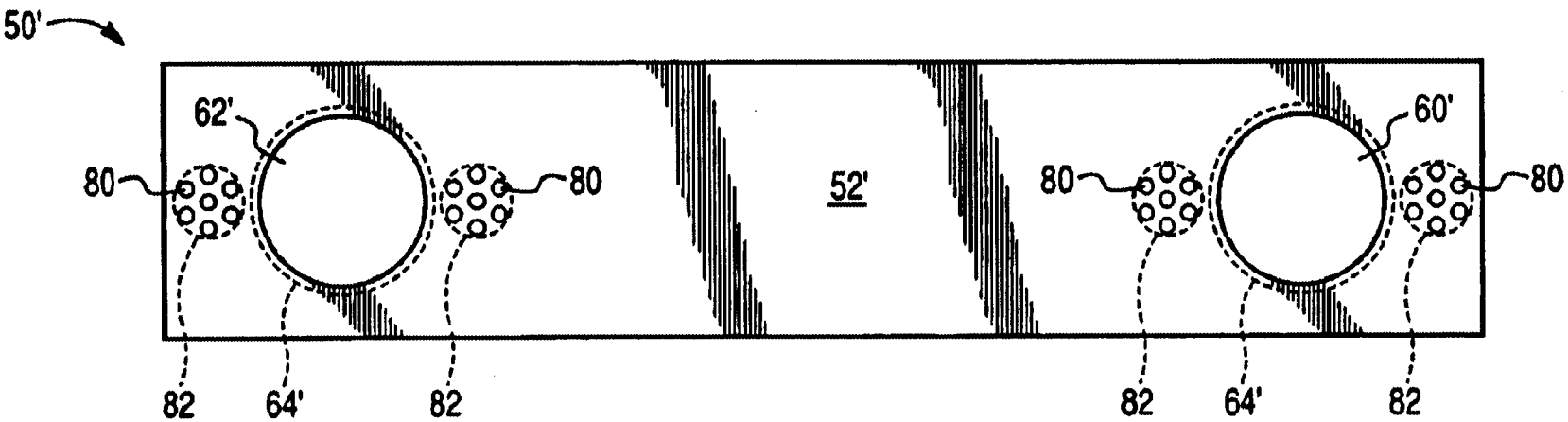
FIG. 7 is a top plan view of a second embodiment of a reinforcing plate according to the present invention.
Figure 8:
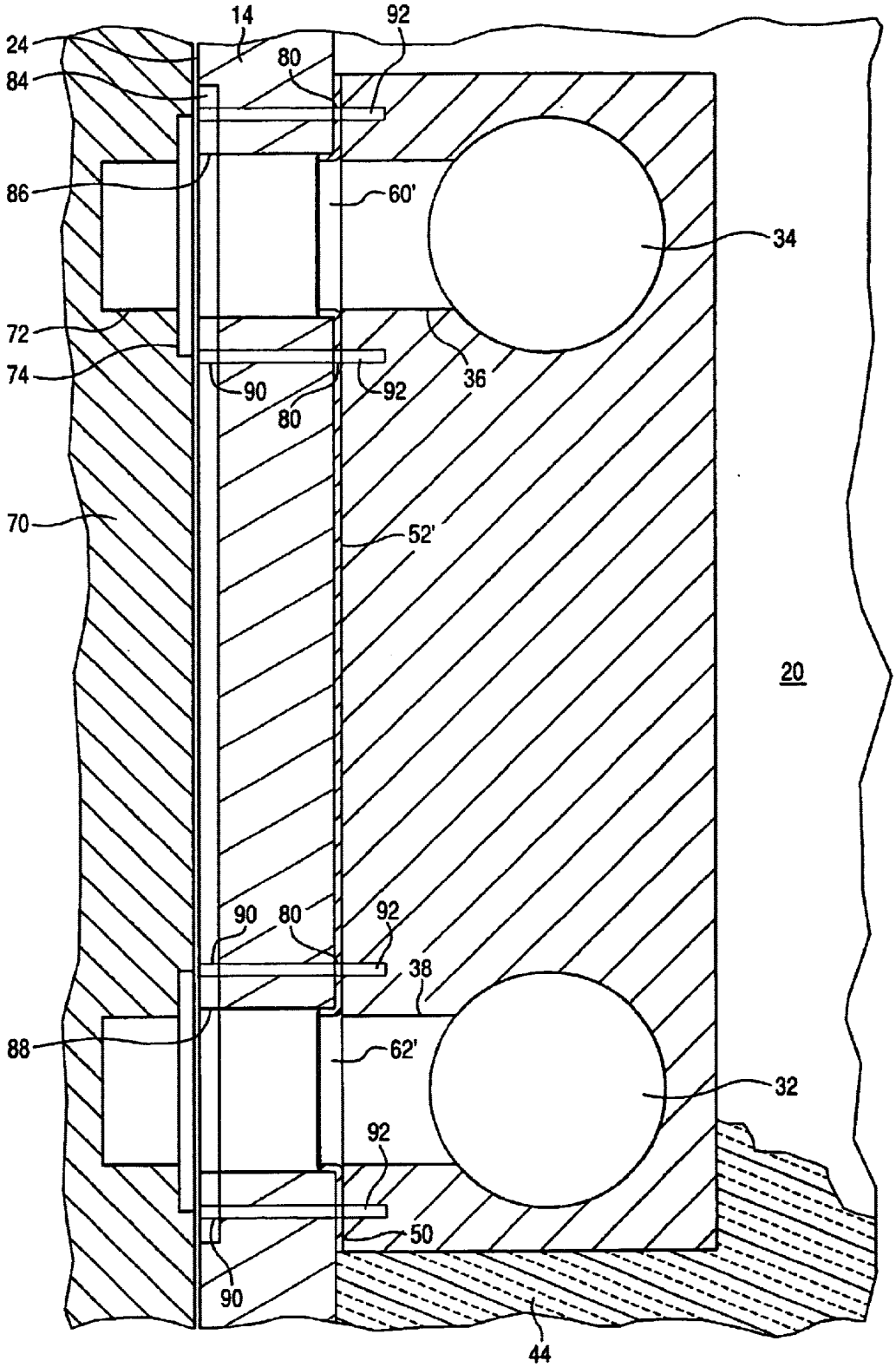
FIG. 8 is a sectional view of a door incorporating a latch plate and the reinforcing plate of FIG. 7 positioned adjacent a door jamb.
Figure 9:
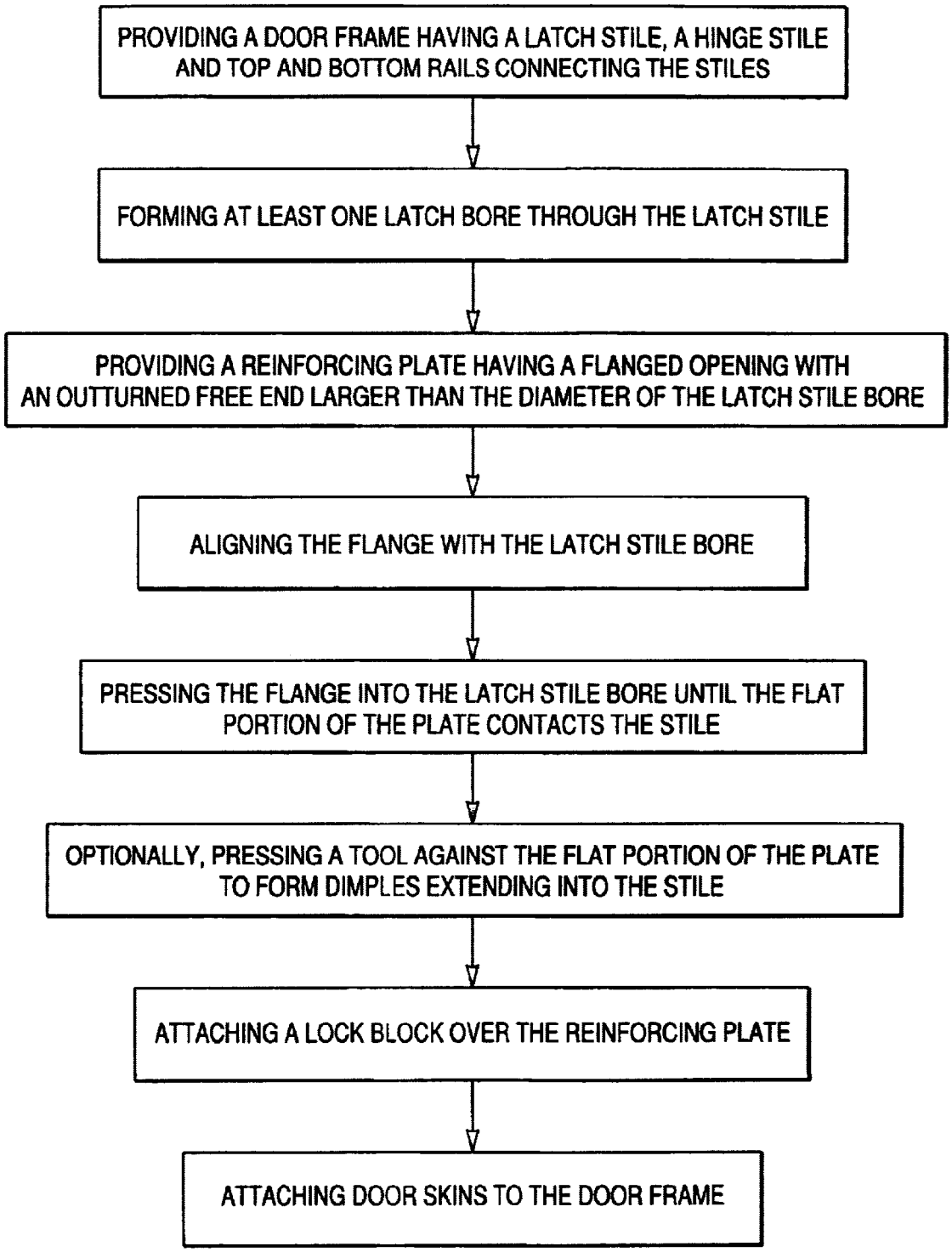
FIG. 9 is a flow chart showing a method of assembling the door assembly of FIG. 1.

A second embodiment of a reinforcing plate according to the present invention is shown in FIGS. 7 and 8 wherein elements identical to elements of the first embodiment are identified with the same reference numerals and wherein elements of the alternate reinforcing plate that correspond to elements of the reinforcing plate of the first embodiment are identified with like reference numerals and primes. In this embodiment, reinforcing plate 50' includes a plurality of screw holes 80 arranged in generally circular groups 82 on either side of holes 60' and 62' in the plate along the longitudinal midline of the plate. The screw holes are preferably about ⅛ inch in diameter and the diameter of the circular groups is about ½ inch, so that very little space is left between the screw holes. Plate 50' is installed against latch stile 14 in the same manner as the reinforcing plate of the first embodiment. However latch stile 14 is provided with a latch plate 84 which includes a first opening 86 that surrounds upper bore 26 in the latch stile and a second opening 88 that surrounds lower bore 28 in the latch stile. Latch plate 84 also includes openings 90 adjacent openings 86 and 88 for receiving fasteners such as screws 92 to secure the latch plate to the latch stile. Normally, a latch plate would be attached to a latch stile using a ⅝ or ¾ inch screw, but in this embodiment, screws 92 are at least about 1⅜ inches long so that they will extend though the stile and reinforcing plate and into the lock block.

A door including reinforcing plate 50' is assembled in the manner described above and then latch plate 84 is positioned on the outside of the latch stile with latch plate opening 86 aligned with upper bore 26. Each of openings 90 in the latch plate is located directly opposite latch stile 14 from one of the circular groups 82 of screw holes 80. When a screw 92 is inserted through the latch plate and driven through the latch stile, its leading end will engage one of the plurality of holes in one of the groups of holes and pass through that hole and into lock block 30. This arrangement helps anchor the lock block securely to the latch stile and holds reinforcing plate 50' very securely between these two elements, even when a forced entry is attempted.

The present invention has been described above in terms of a preferred embodiment. Modifications and additions to this embodiment will become apparent to those skilled in the art upon a reading and understanding of the above description and the accompanying drawing figures. For example, the reinforcing plate is shown as having two openings, but could just as easily have a single opening for use in situations where a deadbolt is not present, or three or more openings where the number of bolts extending though the stile so requires. It is intended that all such obvious modifications and additions be covered by this application to the extent that they are included within the scope of the several claims appended hereto.

I claim:

1. A door comprising:

a first stile having a front wall, a rear wall, an inner wall, and an outer wall;

a second stile parallel to and spaced from said first stile and including an inner wall facing said first stile inner wall;

a first door skin connected to said first stile and to said second stile;

a second door skin connected to said first stile and to said second stile;

a first lock bore extending through said first door skin and said second door skin; and a first latch bore extending from said first lock bore through said first stile inner wall and said first stile outer wall; and a reinforcing plate connected to said first stile inner wall having a first opening aligned with said first latch bore.

2. The door of claim 1 including at least one fastener for securing said reinforcing plate to said first stile.

3. The door of claim 2 wherein said means for securing comprises at least one protrusion extending into said first stile.

4. The door of claim 3 wherein said at least one protrusion is spaced from said first opening.

5. The door of claim 1 wherein said reinforcing plate first opening includes a first flange extending into said first latch bore.

6. The door of claim 5 wherein said first flange includes an end edge flared away from the centerline of said lock bore.

7. The door of claim 5 wherein said first latch bore has a diameter and said first flange has a width greater than said diameter.

8. The door of claim 7 wherein said reinforcing plate includes at least one projection extending into said first stile at a location spaced from said first latch bore.

9. The door of claim 1 including a second lock bore extending though said first door skin and said second door skin parallel to said first lock bore and a second latch bore extending from said second lock bore through said first stile parallel to said first latch bore and wherein said reinforcing plate includes a second opening aligned with said second latch bore.

10. The door of claim 9 wherein said reinforcing plate second opening includes a flange having a width greater than the diameter of said second latch bore.

11. The door of claim 10 including a plurality of projections on said reinforcing plate spaced from said second opening and extending into said first stile.

12. The door of claim 1 wherein said reinforcing plate is press-fitted to said first stile inner wall.

13. The door of claim 1 wherein said reinforcing plate includes at least one hole adjacent said first opening and wherein said door includes a latch plate attached to said first stile outer wall around said first latch bore and at least one fastener extending though said latch plate and latch stile and said at least one hole.

14. A method of forming a door comprising the steps of:

providing a frame including first and second parallel stiles having facing inner walls, a top rail connected between said first and second stiles and a bottom rail connected between said first and second stiles;

forming a latch bore having a diameter through said first stile inner wall;

providing a reinforcing plate including a flanged opening having a width greater than said first diameter;

aligning said reinforcing plate opening with said latch bore in said first stile inner wall;

placing said reinforcing plate flange against said latch bore;

applying pressure to said reinforcing plate to force said flange into said latch bore and said reinforcing plate against said first side stile inner wall; and attaching first and second door skins to said frame.

15. The method of claim 14 including the additional step of attaching said reinforcing plate to said inner stile at a plurality of locations.

16. The method of claim 15 wherein said step of attaching said reinforcing plate to said inner stile comprises press fitting.

17. The method of claim 16 including the additional step of attaching a lock block to said inner stile over said reinforcing plate.

18. The method of claim 14 including the step of driving a punch against said reinforcing plate at a plurality of locations.

19. The method of claim 14 including the additional steps of attaching a lock block to said latch stile inner wall over said reinforcing plate;

attaching a latch plate to said latch stile outer wall; and driving a fastener through said latch plate, said latch stile and said reinforcing plate and into said lock block.

20. A hollow-core door comprising:

a door frame including a latch stile, a hinge stile, and a top stile and a bottom stile connected between said latch stile and said hinge stile, said latch stile having an inner wall facing said hinge stile and a latch bore though said inner wall;

a reinforcing plate having an opening with a flange, a first portion of said flange having a width greater than the width of said latch stile latch bore and extending into said latch stile latch bore, said reinforcing guard overlying said latch stile inner wall and including at least one projection extending into said latch stile at a location spaced from said latch stile latch bore;

a lock block having a lock bore connected to said latch stile inner wall and having a lock block latch bore aligned with said latch stile latch bore; and, first and second door skins connected to said door frame and having openings aligned with said lock bore.

21. The door of claim 19 wherein said reinforcing plate includes at least one dimple extending into said latch stile.

22. A door comprising:

a first stile having a front wall, a rear wall, an inner wall, and an outer wall;

a second stile parallel to and spaced from said first stile and including an inner wall facing said first stile inner wall;

a lock block connected to said first stile inner wall;

a first door skin connected to said first stile and to said second stile;

a second door skin connected to said first stile and to said second stile;

a first lock bore extending through said first door skin, said lock block and said second door skin;

a first latch bore extending from said first lock bore through said lock block, said first stile inner wall and said first stile outer wall;

a reinforcing plate connected to said first stile inner wall having a first opening aligned with said first latch bore and at least one hole adjacent said first opening;

a latch plate attached to said latch stile outer wall and having an opening aligned with said first latch bore and a hole for receiving a fastener; and at least one fastener extending through said latch plate hole, said latch stile, said reinforcing plate at least one hole and into said lock block.

* * * * *